United States Patent [19]

Roedig

[11] Patent Number: 4,635,827

[45] Date of Patent: Jan. 13, 1987

[54] SEALANT APPLICATOR FOR RIVET MACHINE

[75] Inventor: Robert Roedig, Farmingdale, N.Y.

[73] Assignee: Grumman Aerospace Corporation, Bethpage, N.Y.

[21] Appl. No.: 698,971

[22] Filed: Feb. 6, 1985

[51] Int. Cl.[4] ..... B67D 5/54

[52] U.S. Cl. ..... 222/160; 222/326; 222/334; 222/389; 901/41; 118/410

[58] Field of Search ..... 222/326, 334, 389, 398, 222/160, 399, 320; 401/141, 142, 188 R, 99, 100, 101; 118/410, 411; 901/41, 43; 29/243.53, 34 B

[56] References Cited

U.S. PATENT DOCUMENTS

| | | | |
|---|---|---|---|
| 2,426,969 | 9/1947 | Hallowell, Jr. | 118/408 |
| 3,350,774 | 9/1967 | Bridges, Sr. | 29/564 |
| 3,420,208 | 1/1969 | Guthrie | 118/411 X |
| 3,455,275 | 7/1969 | Podesta et al. | 118/317 |
| 3,747,193 | 7/1973 | Gregory | 29/243.53 |
| 3,796,783 | 3/1974 | Greever | 264/135 |
| 3,813,012 | 5/1974 | Laird | 222/334 X |
| 3,904,718 | 9/1975 | Kuehn, Jr. | 264/39 |
| 4,144,625 | 3/1979 | Hogenhout | 29/34 B |
| 4,244,319 | 1/1981 | Carstedt | 118/411 |

FOREIGN PATENT DOCUMENTS

| | | | |
|---|---|---|---|
| 2216598 | 10/1973 | Fed. Rep. of Germany | 222/389 |

*Primary Examiner*—Joseph J. Rolla
*Assistant Examiner*—Nils E. Pedersen
*Attorney, Agent, or Firm*—Pollock, VandeSande & Priddy

[57] ABSTRACT

A disposable sealant piston-cartridge is itself connected to a motion actuation pressure driven piston mounted to the transfer head of a riveter machine. Between countersink and rivet operations, the actuating piston moves a sealant cartridge spring loaded nozzle into engagement with a countersink and upon pressurization of the sealant piston cartridge, a bead of sealant is deposited into the countersink.

8 Claims, 8 Drawing Figures

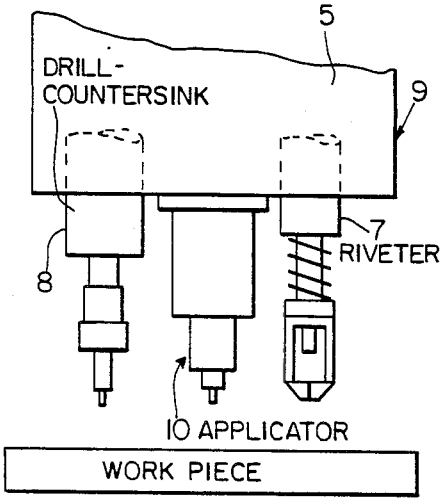
FIG. 1
FIG. 2
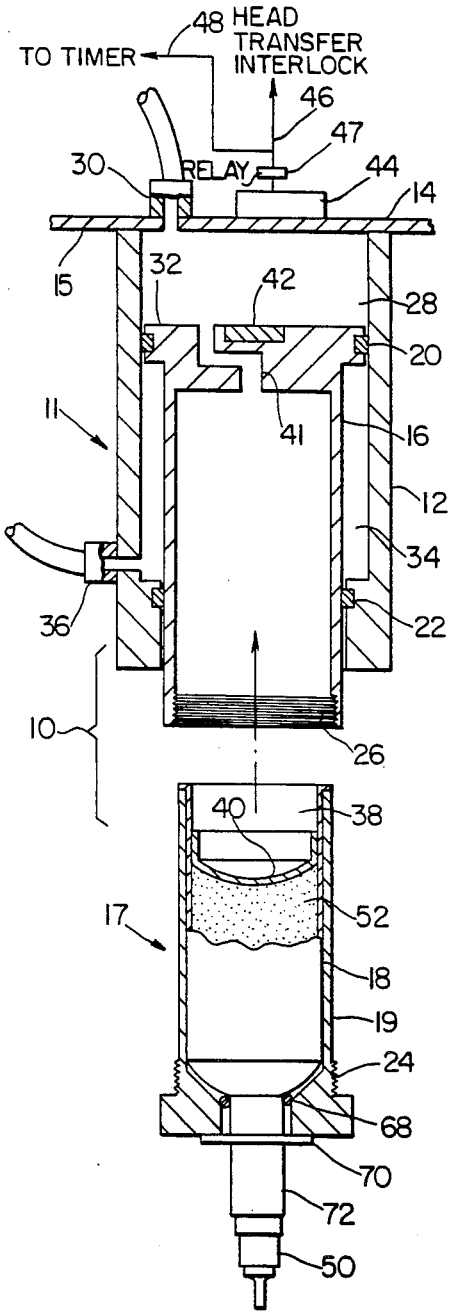

SEALANT APPLICATOR FOR RIVET MACHINE

FIELD OF THE INVENTION

The present invention relates to a sealant applicator, mounted on an automatic drilling riveting machine, which is capable of depositing a bead of sealant in a workpiece countersink, between the machine steps of countersinking and riveting.

BRIEF DESCRIPTION OF THE PRIOR ART

The aircraft industry uses primers and sealants as protection for the rivet-skin interface in riveted structures such as aircraft wings and aircraft fuselages. The checking of paints on the surface of the composite structure and/or working of joints permits corrosive materials in the atmosphere to be drawn into and attack the rivet or skin material adjacent the rivet, occasionally resulting in failure of the structure. In many structures in which the rivets are inserted by hand, a manual sealant gun is utilized to extrude sealant over the rivet heads and on hidden surfaces. With automated equipment, it is necessary to apply sealant material during the riveting cycle, that is, after hole drilling and countersinking, but before rivet insertion in order to maintain adequate riveting rates with the necessary quality control to form adequate joints.

When utilizing automated equipment, such as riveting machines, a workpiece is clamped into place. While thus held tightly the several operating attachments comprising the machine sequentially drill a series of holes therein, countersink each where required, insert a fastener in each hole, secure the fastener, and release and unclamp the parts. In order to introduce sealing to this automated system, it becomes necessary to rework the machine by incorporating means to apply a sealant prior to installation of each fastener so that when the fastener is installed it is surrounded by the sealant. This unduly interrupts the normal cycle of the machine unless the sealant applying step is completed substantially within the relatively brief interval between the drilling and fastener inserting operation. At the same time it is important that the sealant be properly applied in the hole, i.e., totally cover the surfaces of the parts and yet not in an excessive manner so as to require an unreasonable clean-up time, which would defeat high speed performance, the very purpose of the machine.

U.S. Pat. No. 3,904,718 discloses a sealant application method relying upon dabber action. More specifically, the cylindrically shaped dabber is provided with a groove and a sealant operation requires the groove to align precisely with a bead of sealant. The bead fills the groove and the cylindrical dabber is then inserted into a countersink; and by rotating the dabber in the countersink, the walls of the countersink become covered with sealant material. Another form of sealant application, using the dabber approach is disclosed in U.S. Pat. No. 4,144,625. In both cases extensive mechanical linkages must be employed to wet the dabber at a first position and move it to a second countersink dabbing position. Such mechanical linkages in the environment of high speed production are prone to wear which causes misregistration of the dabber with respect to a countersink thereby failing in the intended purpose of the apparatus. Consequently, applicators such as disclosed in these U.S. patents require constant critical adjusting.

U.S. Pat. No. 3,350,774 discloses a pressurized sealant nozzle which ejects sealant into a countersink. However, as shown in FIGS. 2 and 3 of this patent, the applicator is mounted to a linkage mechanism which extends and withdraws the applicator from a countersink, inbetween countersink and riveting positions of a workpiece. The mechanical linkages utilized in this patent again present the wear and misregistration problems as previously discussed. Further, this applicator requires nozzles and valves to be cleaned periodically so as to ensure efficient sealant application. Of course, when such maintenance is required, the automatic riveting tool must be shut down until maintenance is completed.

BRIEF DESCRIPTION OF THE PRESENT INVENTION

The present invention utilizes a pressure driven piston mechanism for displacing an applicator vertically with respect to a countersink in a workpiece that is to be sealed. Mechanical linkages are avoided totally so that the problems of wear and misregistration are not present.

Further, the present invention utilizes a disposable sealant cartridge having an integral nozzle that is quickly and easily replaced in the applicator mechanism thereby avoiding the necessity of maintenance for nozzles and valves as was the case in previously mentioned U.S. Pat. No. 3,350,774.

The present invention executes simple reciprocal motion of a sealant nozzle between a retracted and extended countersink engaging position so that periodic critical adjustments are not necessary. As a result the present invention offers a sealant mechanism which is compatible with automatic rivet machine operation while avoiding reliability and maintenance problems which have plagued the prior art.

BRIEF DESCRIPTION OF THE FIGURES

The above-mentioned objects and advantages of the present invention will be more clearly understood when considered in conjunction with the accompanying drawings in which:

FIG. 1 is a side elevational view of the present sealant applicator as installed on the head of an automatic drill-rivet machine;

FIG. 2 is a disassembled cross-sectional view illustrating the two basic components of the present invention;

DETAILED DESCRIPTION OF THE INVENTION

Figures 3A, 3B, 3C:
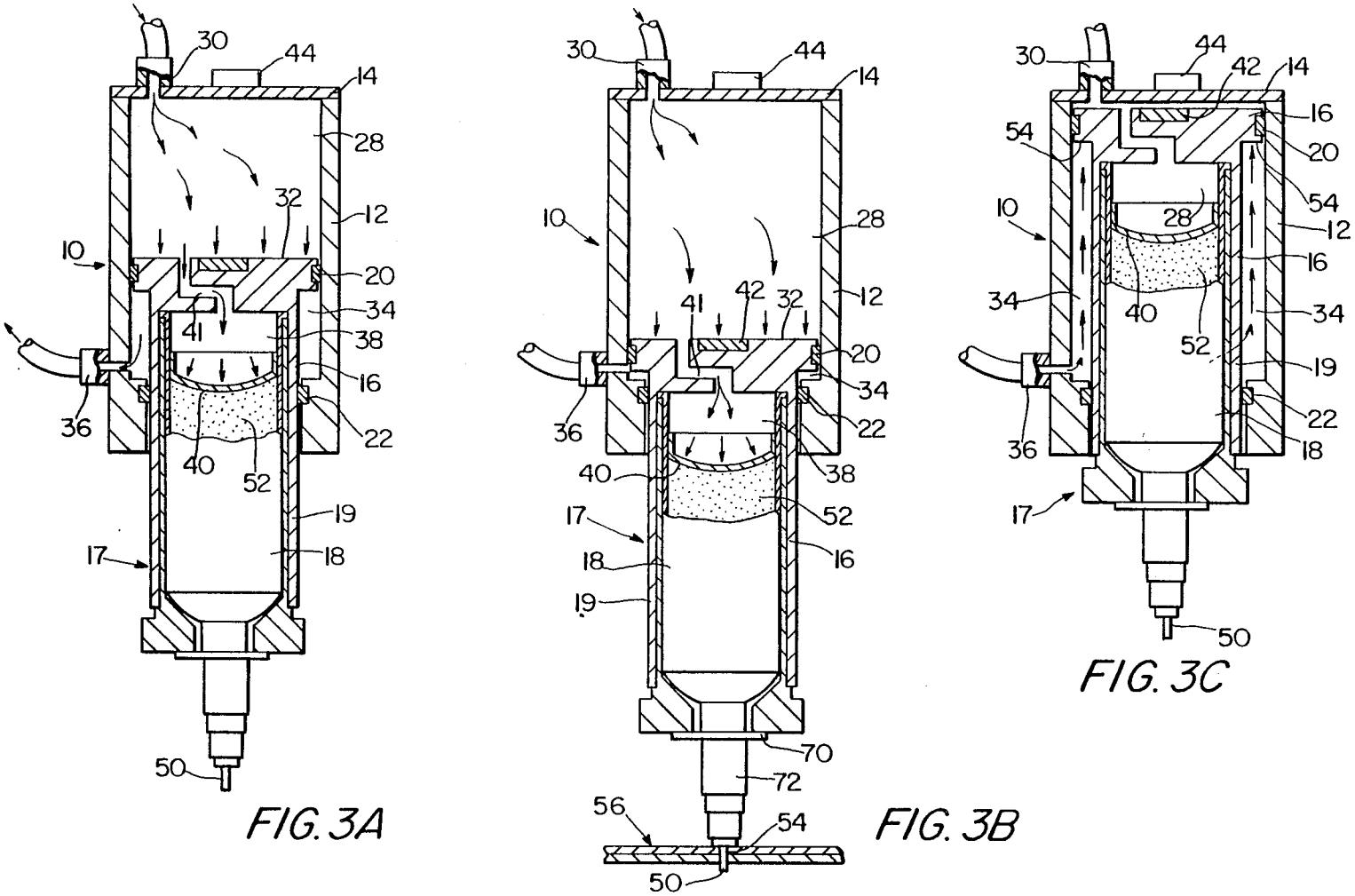
FIG. 3A is a cross-sectional view illustrating the present invention in an extended position.
FIG. 3B is a cross-sectional view illustrating the present invention in a fully extended position while applying sealant to a workpiece.
FIG. 3C is a cross-sectional view illustrating the present invention in a fully retracted position.

Referring to the figures and more particularly FIG. 1 thereof, the relative positioning of an applicator 10, which constitutes the present invention, is shown on a drill-rivet machine 9 between a drill-countersink 8 and a riveter 7. Although the structure of the present invention has general application for applying sealant or other materials of like consistency, the invention will be explained in connection with its preferred utilization for sealant applications with a drill-rivet machine, such as the GEMCOR DRIVEMATIC machine, manufactured by the General Electric Company. A drilled hole with countersink is formed by drill-countersink 8; and prior to the positioning of the drilled hole at the riveter 7, the applicator 10 engages the hole to deposit a bead of sealant around the countersink.

FIG. 2 illustrates the two basic components of the applicator 10. The upper component generally indicated by reference numeral 11 is seen to include a generally cylindrical body 12 having a cap 14 on an upper end thereof which may be attached to machine 9. The centrally positioned cylindrical piston 16 is coaxially located with respect to body 12 and, as will be explained hereinafter, the body remains fixed during operation of the applicator while piston 16 moves upwardly and downwardly during extension and retraction of an applicating nozzle. Thus, it is piston action which achieves applicator movement to the workpiece as opposed to the complex linkage mechanisms taught by the prior art as previously discussed.

In order to avoid time-consuming nozzle and valve cleanups, the present invention incorporates a disposable sealant piston cartridge 18 which is located within a cylindrical sleeve 19 which has a threaded surface 24 and a first end portion thereof which engages an interiorly threaded portion 26 of piston 16. Thus, during operation of the device when piston 16 moves toward or away from a workpiece, the cylindrical sleeve 19, being fixed to it, undergoes the same motion. Piston seals 20 and 22 seal the interfacing surfaces between piston body 12 and piston 16.

With continued reference to FIG. 2, an upper air chamber 28 is seen to exist between the upper surface 32 of the piston 16 and the interior surface of cap 14. At the lower end of the sealant cartridge 18 is a nozzle 50 through which sealant material 52 passes when piston 16 is actuated to a fully extended position, as will now be explained.

FIG. 3A illustrates the mechanism for extending the piston 16 as well as the lower adapter section 17 which carries sealant cartridge 18. Pressure is provided at port 30 which causes pressurization of the upper air chamber 28. The upper piston surface 32 is subjected to the pressure forces and this forces the piston downwardly. The lower air chamber 34, below the section of piston 16 which receives seal 20, vents to port 36 thereby ensuring a positive pressure differential between the upper and lower air chambers.

A piston air passage 41 is formed in the upper portion of piston 16 and permit communication between the upper air chamber 28 and the cartridge air chamber 38. The sealant cartridge has its own piston 40 which becomes displaced downwardly when the upper air chamber 28 becomes pressurized, due to pressure communication between that air chamber and the cartridge air chamber 38, via piston air passage 41.

The upper portion of the piston 16 is bored to receive a magnet 42. On an opposing upper surface of cap 14 is a mating reed switch 44. Upon downward extension of piston 16, a magnetic circuit between the reed switch and the magnet is broken thereby establishing an electrical signal at wire 46 which is connected to a relay 47 (FIG. 2) which in turn controls a conventional safety interlock to prevent the riveting machine's transfer head 5 (FIG. 1) from shifting while the applicator is extended. The relay 47 also activates, along wire 48, an adjustable timer which determines how long the piston remains extended.

In operation of the device, as regulated pressurized air enters the upper chamber 28 through port 30, the piston 16 is moved downwardly to the fully extended position shown in FIG. 3B. When this occurs, nozzle 50 at the lower end of the applicator enters a predrilled hole with countersink 54 formed in workpiece 56. Upon contact the nozzle 50, which incorporates a spring-tip valve (not shown), opens and permits sealant material 52 to be forced out by the pressure on the sealant cartridge piston 40. By way of example, the spring-loaded valve nozzle 50 as well as the sealant cartridge 18 are available from SEMCO, Inc.

When a timer (not shown) reaches a timed period, pressurized air enters port 36 as shown in FIG. 3C to initiate a piston retraction cycle. Simultaneously, the port 30 is exhausted to the atmosphere. The pressurized air in the lower air chamber 34 then forces piston 16 upward. as the nozzle is brought out of engagement with the workpiece, the spring-tip valve closes, which prevents any further application of sealant until a following extension cycle. As piston 16 reaches the end of its upward stroke, as shown in FIG. 3C, magnet 42 is again brought within close proximity of reed switch 44 and the switch is closed. This allows the machine 9 (FIG. 1) to continue to a subsequent rivet operation and during this time the timer is reset for the next cycle.

Figure 4C:
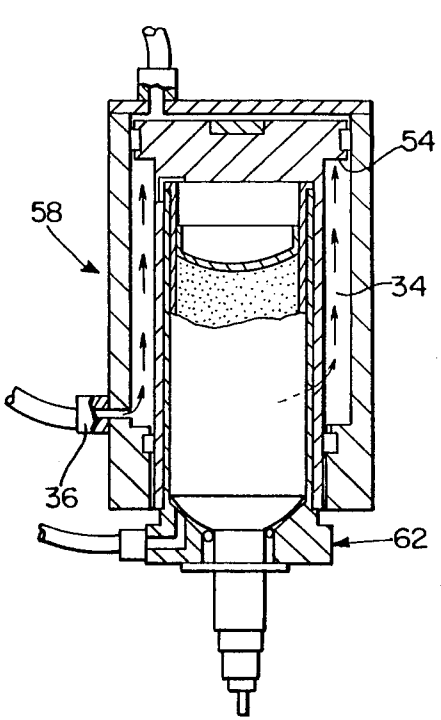
FIG. 4C is a cross-sectional view illustrating a second embodiment of the present invention in a fully retracted position.
Figure 4B:
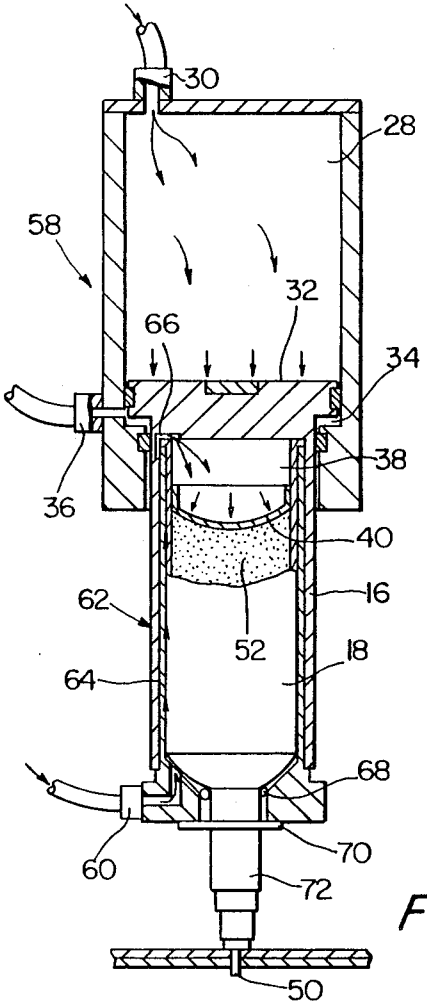
FIG. 4B is a cross-sectional view illustrating a second embodiment of the present invention in a fully extended position while applying sealant to a workpiece.
Figure 4A:
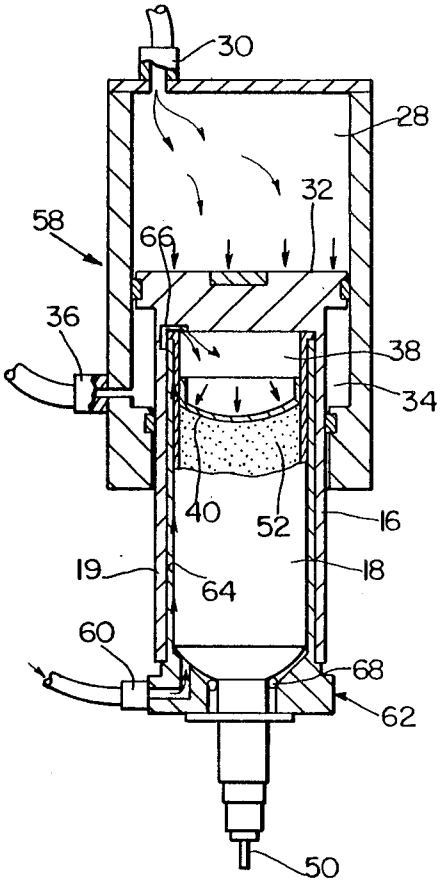
FIG. 4A is a cross-sectional view illustrating a second embodiment of the present invention in an extended position.

In the event materials are used which have high viscosity or low viscosity, it may be desirable to create an independent pressure condition for the sealant cartridge piston 40 without affecting the speed at which piston 16 travels between the extended and retracted positions. In order to achieve this independence, reference is made to a second embodiment 58 shown in FIGS. 4A–C which correspond to FIGS. 3A–C with a few critical exceptions. In the following description of this alternate embodiment 58, components that are similar to the previously discussed embodiment of FIGS. 2 and 3A–C and FIGS. 4A–C will be similarly numbered. A first major distinction of the second embodiment is the elimination of the piston air passage 41. Thus, there is no pressure communication between the upper air chamber 28 and the cartridge air chamber 38.

A third air port exists in the lower portion of sleeve 62 which receives a sealant cartridge 18. Sleeve 62 differs from sleeve 19 of the previous embodiment by virtue of a groove 64 formed along the inside wall of sleeve 62 which permits the communication of pressure from port 60 to cartridge air chamber 38, via a generally L-shaped passageway 66, formed in the upper portion of piston 16. An O-ring 68 is positioned between sealant cartridge 18 and the lower interior beveled wall of sleeve 62.

Thus, by adding pressure at port 60 (FIG. 4A), the cartridge air chamber 38 is pressurized separately from the pressure used to force piston 16 downward. This permits independent variation in the pressure used to force out the sealant without affecting the cylinder pressure. Thus, stroke speed is independently regulated. Washer 70 is employed to transmit the contact force of an engaged nozzle against the sleeve 62 and piston 16 of the applicator, instead of plastic cartridge 18. The adapter 72 positions the nozzle 50 at a distance from the lower end of sleeve 62 thereby permitting the nozzle to reach into the pressure foot of a riveting machine. The sleeve 62, washer 70, nozzle 50 and cartridge assembly are easily unscrewed from the upper portion of the adapter for simple and quick replacement of the sealant cartridge 18.

It should be understood that, although the previous discussion of the invention centered around use of a sealant material, the present invention has general application to other types of materials as well.

It should be understood that the invention is not limited to the exact details of construction shown and described herein for obvious modifications will occur to persons skilled in the art.

I claim:

1. A material applicator comprising:

a piston body enclosing a first piston;

a sleeve mounted within the first piston;

a piston cartridge containing material, the cartridge being removably positioned in the sleeve;

a spring-loaded valve nozzle extending outwardly from the cartridge for depositing a bead of material on a contacted surface;

means for pressurizing a first chamber existing between the first piston and a cap of the body for extending the first piston outwardly from the body thereby causing similar extension of the sleeve and the piston cartridge connected thereto; and means pressurizing a second chamber existing between the piston cartridge and the first piston for pressurizing the material in the piston cartridge and causing ejection of material upon displacement of the valve nozzle to an open position after nozzle contact with a surface.

2. The structure set forth in claim 1 together with electromagnetic sensing means mounted between the first piston and a stationary point on the cap for detecting extension of the first piston relative to the body.

3. The structure of claim 2 wherein the applicator is mounted to the transfer head of an automatic multi-tool machine and further wherein means are connected between the electromagnetic means and a safety interlock of the machine for preventing the transfer head from shifting while the first piston is extended.

4. The structure set forth in claim 3 together with means for connecting the sensing means to a timer for determining the interval during which the first piston remains extended.

5. A material applicator comprising:

a piston body enclosing a first piston;

a sleeve mounted within the first piston;

a piston cartridge containing material, the cartridge being removably positioned within the sleeve;

a spring-loaded valve nozzle extending outwardly from the cartridge for depositing a bead of material on a contacted surface;

a first port communicating with a first chamber existing between the first piston and a cap of the body for extending the first piston outward from the body thereby causing a similar extension of the sleeve and the piston cartridge connected thereto;

a passage connected between the first chamber and a second chamber existing between the piston cartridge and the first piston for pressurizing the material in the piston cartridge and causing ejection of material upon displacement of the valve nozzle to an open position after nozzle contact with a surface;

a second port communicating with a third chamber existing between the first piston and the body, the third chamber being axially spaced relative to the first chamber for pressurizing the third chamber and causing retraction of the first piston into the body resulting in a similar retraction of the sleeve and the piston cartridge connected thereto.

6. The structure of claim 5 wherein the applicator is mounted to the transfer head of an automatic multi-tool machine and further wherein means are connected between the electromagnetic means and a safety interlock of the machine for preventing the transfer head from shifting while the first piston is extended.

7. A material applicator comprising:

a piston body enclosing a first piston;

a sleeve mounted within the first piston;

a piston cartridge containing material and removably positioned within the sleeve;

a spring-loaded valve nozzle extending outwardly from the cartridge for depositing a bead of material on a contacted surface;

a first port communicating with a first chamber existing between the first piston and a cap of the body for extending the first piston outward from the body thereby causing a similar extension of the sleeve and the piston cartridge connected thereto;

a second port communicating with a second chamber existing between the sleeve and the piston cartridge, via a passage formed in the sleeve, for pressurizing the material in the piston cartridge and causing ejection of the material upon displacement of the valve nozzle to an open position after nozzle contact with a surface;

a third port communicating with a third chamber existing between the first piston and the body, the third chamber being axially spaced relative to the first chamber for pressurizing the third chamber and causing retraction of the first piston into the body resulting in a similar retraction of the sleeve and the piston cartridge connected thereto.

8. The structure set forth in claim 7 wherein the applicator is mounted to the transfer head of an automatic multi-tool machine and further wherein means are connected between the electromagnetic means and a safety interlock of the machine for preventing the transfer head from shifting while the first piston is extended.

* * * * *